US005661274A

United States Patent [19]

Koehler

[11] Patent Number: 5,661,274

[45] Date of Patent: Aug. 26, 1997

[54] PRECISION DOUBLE-POLE SINGLE-THROW SWITCH ASSEMBLY

[75] Inventor: Randal W. Koehler, Madison, Ala.

[73] Assignee: Eaton Corporation, Cleveland, Ohio

[21] Appl. No.: 512,580

[22] Filed: Aug. 8, 1995

[51] Int. Cl.[6] ..... H01H 5/22

[52] U.S. Cl. ..... 200/16 R; 200/459

[58] Field of Search ..... 200/16 R–16 D, 200/402, 405–409, 440–443, 445–468, 520, 521, 530–532, 537, 329, 341

[56] References Cited

U.S. PATENT DOCUMENTS

| | | | |
|---|---|---|---|
| 3,291,931 | 12/1966 | Rogers | 200/67 |
| 3,624,323 | 11/1971 | Borgmann | 200/67 D |
| 3,735,080 | 5/1973 | Andresen | 200/67 D |
| 5,086,198 | 2/1992 | Arakawa | 200/456 |
| 5,239,151 | 8/1993 | King et al. | 200/458 |

*Primary Examiner*—Cassandra C. Spyrou
*Assistant Examiner*—Michael A. Friedhofer
*Attorney, Agent, or Firm*—Roger A. Johnston

[57] ABSTRACT

A double-pole single-throw switch has a pair of spaced stationary contacts adapted for carrying current to individual circuits. A cantilevered, torsionally flexible, electrical current carrying arm has a pair of correspondingly spaced moveable contacts mounted on the free end and disposed adjacent the stationary contacts. A toggle spring actuator has one reaction end engaging a slot in the end of the electrical current carrying arm for effecting relative lost motion movement and impacting the sides of the slot for causing rapid making and breaking and a wiping motion of the contacts. The spring engages the slot midway between the contacts to permit angular movement to accommodate misalignment of the stationary contacts.

9 Claims, 2 Drawing Sheets

PRECISION DOUBLE-POLE SINGLE-THROW SWITCH ASSEMBLY

BACKGROUND OF THE INVENTION

The present invention relates to electrical switches of the type employed for simultaneous making and breaking of two separate electrical circuits by movement of a common switch actuator member. In particular the invention relates to such switches which function in a double-pole single-throw mode of operation where it is desired to have the making and breaking of the separate circuits accomplished by a relatively small motion input to the common actuator. Switches of the type having such a relatively low motion input for actuation are commonly referred to as microswitches and are employed in applications where only a relatively small amount of input movement is available for switch actuation and yet a high degree of precision is required with respect to the switch actuation or set point and the deadband or differential permissible for deactuation. A typical application for such a precision double-pole single-throw microswitch is that of a thermostat employed for controlling plural heaters or motors in a thermally responsive control system for an appliance. Known thermostats for appliance control have employed separate individual microswitches positioned for actuation by common actuator member and in such known arrangements great difficulty has been experienced in providing near simultaneous actuation of the switches responsive to movement of the common actuator member. In applications where the switch actuator is moved by very small motion input such as in a thermostat, it has proven extremely difficult to provide a tight deadband or a small differential between opening and closing of the switch contacts sufficient to provide the desired sensitivity of switching to the small motion input of the thermally responsive element. This difficulty in providing switching sensitivity is encountered even in single-pole single-throw switch actuation by a small motion input and particularly a thermally responsive element, and is significantly compounded in providing a double-pole single-throw switch arrangement for common actuation by a small motion input such as a common thermally responsive element. Accordingly, it has long been desired to provide a way or means of actuating a plurality of electrical switch contacts with a common actuator in response to a small motion input such as by a thermally responsive element and to provide a small or tight differential between opening and closing sufficient to provide the desired responsiveness to the input motion particularly with a thermal element.

SUMMARY OF THE INVENTION

It is an object of the present invention to provide nearly simultaneous making and breaking of double-pole switching contacts for controlling current flow in separate circuits by user effected movement of a common actuator.

It is a further object of the invention to provide a double-pole single-throw switch having a common actuator and which can accommodate misalignment of the contacts and function to provide near simultaneous making and breaking.

A further object of the present invention is to provide a double-pole single-throw switch with near simultaneous making and breaking of the contacts and to provide a fast acting make and break function.

The present invention provides a switch assembly having a common actuator with a toggle action which contacts a moveable switch blade member having a pair of moveable contacts thereon which are disposed adjacent a corresponding pair of spaced stationary contacts for controlling current flow to two separate circuits. The switch actuator engages the snap blade member and through lost-motion engagement, contacts the current carrier member at a point midway between the moveable contacts to permit angular movement of the current carrier member for accommodating misalignment of the stationary contacts. The lost motion engagement enables the actuator and snap blade to acquire a significant velocity in either direction of movement before contacting the current carrier member for giving a fast make and break function.

DETAILED DESCRIPTION

Figure 1:
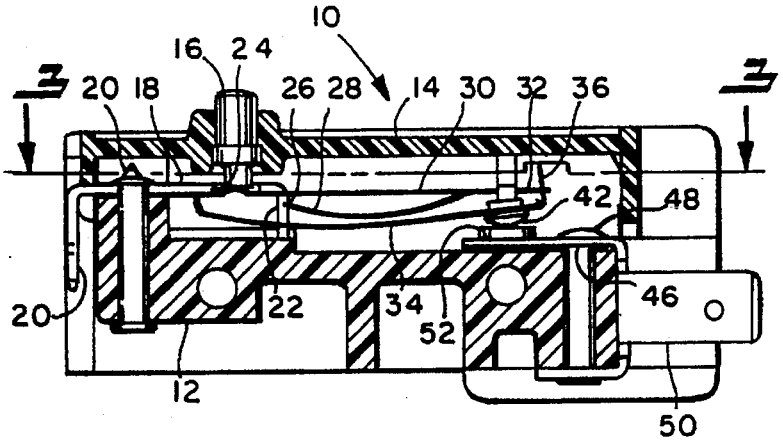
FIG. 1 is a cross-section of the switch assembly of the present invention.

Referring to FIG. 1, the switch assembly is indicated generally at 10 and has a body or base with a cover 14 attached thereto, the cover having received therethrough a plunger 16 slidably guided therein and adapted for external force application thereto by the user and bi-directional vertical movement for effecting operation of the switch.

Figure 2:
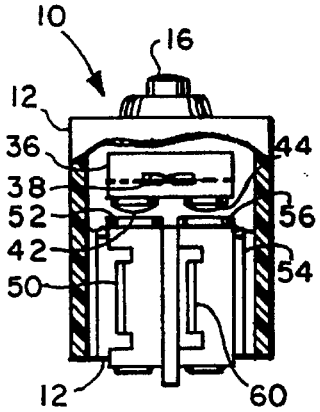
FIG. 2 is a right hand end view of FIG. 1 with portions of the switch casing broken away.
Figure 3:
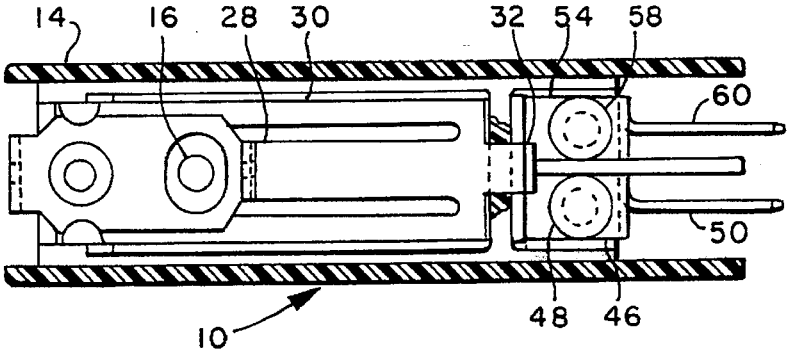
FIG. 3 is a section view taken along section indicating lines 3—3 of FIG. 1.

Referring to FIGS. 1, 2 and 3, a connector terminal member 18 has one end thereof extending exteriorly of the housing or base 12 and having an end portion thereof bent downwardly as denoted by reference numeral 20; and, the terminal is secured to the housing by a suitable expedient as for example rivet 21. The opposite end of the terminal 18 is formed at a generally right angle indicated by reference numeral 22. An aperture 24 is formed in terminal 18 on the portion thereof interior to the housing; and, the aperture 24 is sized to permit one end of the plunger 16 to pass therethrough. The right angle portion 22 of the terminal 18 has a recess or notch 26 formed therein into which is registered one end of a blade spring or tang 28 which is formed as an integral part of the actuator toggle spring 30 which is disposed beneath the terminal 18 and which has one end anchored by rivet 21.

Toggle spring 30 has a projection 32 formed on the end opposite rivet 21 or the free end thereof and which is operative to effect movement of the switch as will hereinafter be described.

The lower end of plunger 16 contacts the upper surface of the toggle spring 30 and is operative upon downward movement of the plunger to cause the toggle spring 30 to pass downwardly past the center position or the vertical location of the recess 26 to effect the toggle or snap action movement thereof.

Figure 7:
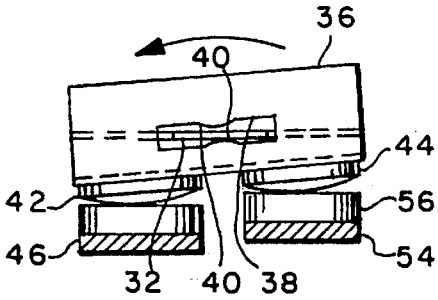
FIG. 7 is a right-hand end view of the switch construction shown in FIG. 5 with the stationary contacts misaligned; and, FIG. 8 is a view similar to FIG. 7 with the stationary contacts aligned.
Figure 8:
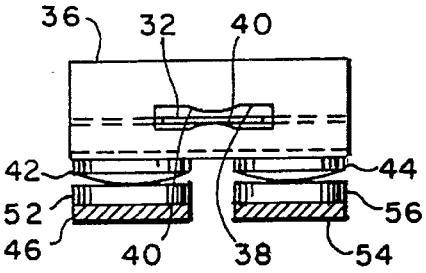

The current carrier arm 34 has one end thereof also anchored by rivet 21 and is disposed beneath the toggle spring 30 and has the opposite or free end thereof extending longitudinally in spaced generally parallel relationship with the toggle spring 30. The end of the current carrier 34 is bent vertically upwardly at generally right angles as denoted by reference numeral 36 and has an elongated slot or aperture 38 formed therein as shown in FIGS. 2, 7 and 8. Slot 38 has a raised portion 40 formed centrally on opposite sides of the slot 38 such that the contact force of the end 32 of the toggle spring is applied centrally to the end 36 of the current carrier in both upward and downward movement of the end portion 32 of the toggle spring.

It will be understood that the slot is configured such that there is a sufficient distance between the upper and lower raised portions 40 to permit a significant lost motion movement vertically in the slot by the end 32 of the toggle spring actuator 30.

Referring to FIGS. 1–3, 7 and 8, the end of the current carrier 34 has a pair of contacts 42,44 attached thereto in transversely spaced relationship. A second connector terminal member 46 is attached to the base 12 by a rivet 48 and the member 46 has a portion 50 extending outwardly of the housing or base 12. Member 46 has a stationary electrical contact 52 attached thereto and disposed adjacent and below the moveable contact 42.

A second connector terminal member 54 is disposed in spaced generally parallel relationship with the member 46; and, the member 54 is secured to the base 12 by the second rivet 58 and has a portion 60 extending outwardly of the base 12 in generally spaced parallel arrangement with the terminal portion 50 of terminal 46. A second stationary contact 56 is disposed spaced adjacent the stationary contact 52 and is positioned immediately under the second moveable contact 44; and, the contact 56 is attached to, preferably by riveting, terminal 54.

Figure 4:
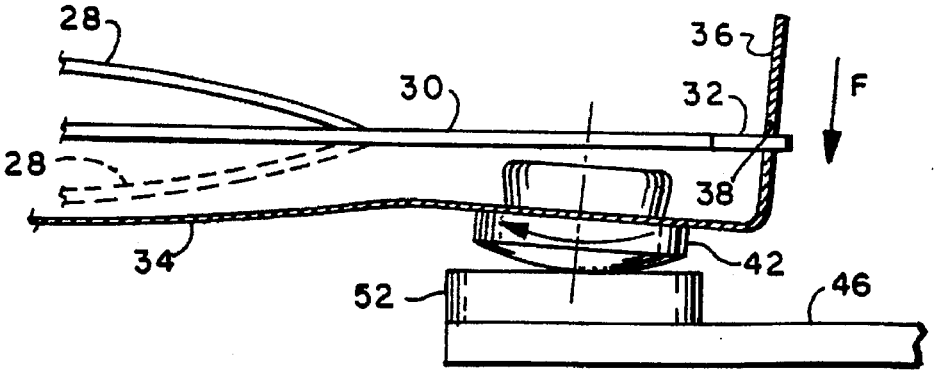
FIG. 4 is an enlarged schematic of the blade arm and actuator toggle spring shown at the point of closing of the moveable contacts against the stationary contacts.

Referring to FIG. 4, the switch toggle spring 30 is illustrated in the position in which it has been moved downwardly by the plunger 16 past the center position coinciding with recess 26 such that the tang 28 has snapped upwardly from the position shown in dashed outline to the position shown in solid outline causing a downwardly directed force indicated by the black arrow and character F to be applied to the spring end 32 which results in its movement from the top of the slot 38 to the bottom of the slot 38 at a relatively high velocity impacting the bottom of the slot 38 and imparting a relatively fast downward movement to the end 36 of the current carrier arm 34. The downward movement of spring end 32 against raised portion 40 of slot 38 causes contact 42 to make contact with the stationary contact 52. The moment of the force F acting about the center line of the contact 42, and flexibility of the current carrier arm 34, causes contact 42 to be rotated in a clockwise direction to produce a wiping movement and position the contact 42 as shown in FIG. 4.

Figure 5:
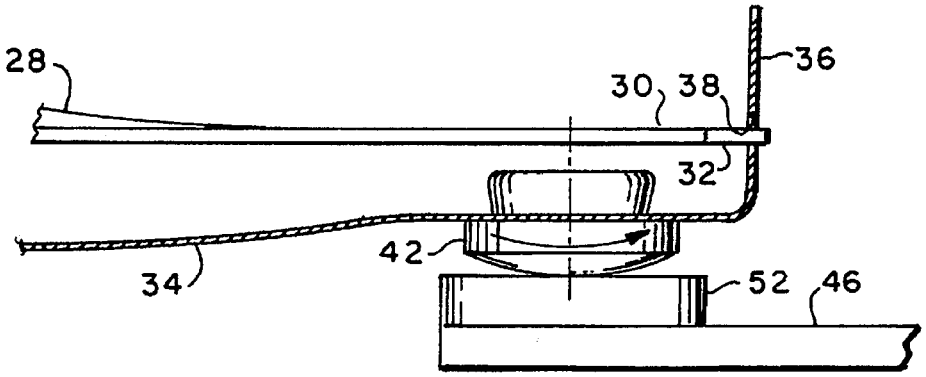
FIG. 5 is a view similar to FIG. 4 showing the blade member with the moveable contact in a closed position against the stationary contact and the actuator approaching toggle for break.

Referring to FIG. 5, user pressure or force on plunger 16 has been relaxed to a point such that the toggle spring member 30 has been permitted to move upwardly a slight amount causing the tang 28 to move near the toggle or center position reducing the force of the spring end 32 on the portion 40 of bottom of slot 38 such that the contact 42 is rotated in the counterclockwise direction to the position shown in FIG. 5. It will be understood that in the position shown in FIG. 5 the tip 32 of the toggle spring member 30 still maintains a slight pressure on the portion 40 of the bottom of slot 38, the pressure being reduced to zero as the tang 28 passes through the center position.

Figure 6:
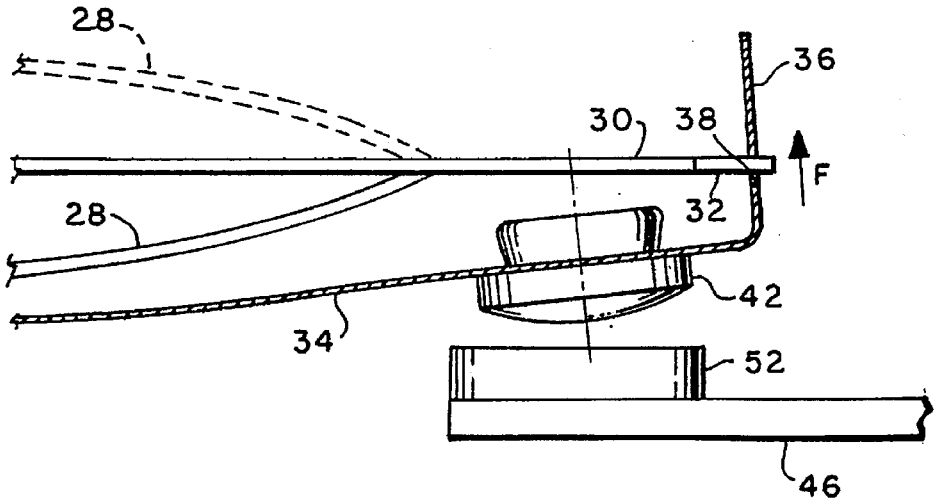
FIG. 6 is a view similar to FIG. 4 showing the blade member and actuator during the fast acting opening of the moveable contacts from the stationary contacts.

Referring to FIG. 6, toggle spring 30 has gone over-center from the upward movement or user release of plunger 16 causing tang 28 to snap from the position shown in dashed outline to the position shown in solid outline thereby applying an upward force to member 30 is shown by the black arrow and reference character F. The upward force F on the toggle spring 30 causes the tip 32 thereof to accrue a relative velocity with respect to the portion 40 of the top of the slot 38 and impact the top of the slot suddenly raising the current carrier arm tip 36 and, due to the flexibility of the current carrier arm 34, causing contact 42 to rotate in a counterclockwise direction producing a wiping motion as it is snapped upwardly to the open position as shown in solid outline in FIG. 6.

Referring to FIGS. 7 and 8, the feature of the invention is illustrated wherein misalignment of the stationary contacts 52, 56 in the vertical direction is accommodated by rotation or twisting of the current carrier end 36 when the downward force of actuator 32 is applied to surface 40 of slot 38. The rotation or twisting of the current carrier end 36 is allowed from the flexibility of the current carrier arms 34.

The present invention thus provides a unique double-pole single-throw switch wherein user movement of a plunger operates a common actuator for moving a switch blade member having a pair of moveable contacts thereon for making and breaking against individual stationary contacts. The actuator member contacts a slot in the current carrier at a point midway between the moveable contacts to accommodate misalignment of the stationary contacts and also provides lost motion in the slot between opposite directions of movement of the actuator in the slot. The lost motion permits the actuator to achieve a relative velocity with respect to the current carrier slot to provide impact thereon to effect a fast action making and breaking of the moveable contacts with respect to the stationary contacts.

Although the invention has hereinabove been described with respect to the illustrated embodiments, it will be understood that the invention is capable of modification and variation and is limited only by the following claims.

I claim:

1. A double-pole single-throw switch assembly comprising:

(a) housing means having a pair of spaced stationary electrical contacts and including individual connector terminal means for external electrical connection thereto;

(b) a resilient electrical current carrying member having a first portion secured to said housing means and a second portion extending distal said first portion, said second portion having a pair of moveable contacts mounted thereon with each disposed adjacent one of said pair of stationary contacts;

(c) spring means having an over-center movement and an actuator integrally formed therewith operative for lost motion movement and contact with said second portion of said current carrying member and upon a user effecting said over-center movement said actuator travels through said lost motion movement at a relatively high velocity and impacts said second portion of said current carrying member and effects rapid movement of said moveable contacts with respect to said stationary contacts.

2. The switch assembly defined in claim 1, wherein said electrical current carrying member second portion has a cut-out therein with said actuator alternately received therein with said actuator contacting opposite sides of said cut-out for effecting said lost-motion movement.

3. The switch assembly defined in claim 1, wherein said spring means and said actuator include an integrally formed blade spring.

4. The switch assembly defined in claim 1, wherein said electrical current carrying member second portion has a cut-out formed therein located equidistant from said moveable contacts.

5. The switch assembly defined in claim 1, wherein said lost motion movement in one direction of a bi-directional movement provides a fast-break action to said moveable contacts.

6. A method of making a double-pole single-throw switch assembly comprising:

(a) forming a body with a pair of spaced stationary contacts;

(b) disposing a pair of moveable contacts on an electrical current carrying arm and stationing said moveable contacts adjacent the stationary contacts;

(c) disposing an over-center spring and an integral actuator on said body and engaging said electrical current carrying arm for lost-motion movement with an end of said actuator;

(d) contacting said spring with a user-moveable member; and, (e) moving said spring over center with said user moveable member and effecting said lost motion movement at a relatively high velocity and impacting said arm moving said moveable contacts.

7. The method defined in claim 6, wherein said step of engaging said current carrying arm includes forming a slot in said current carrying arm and disposing a portion of said spring therein.

8. The method defined in claim 6, wherein said step of contacting said spring includes sliding a plunger in said base.

9. a double-pole single-throw switch assembly comprising:

(a) housing means having a pair of spaced stationary electrical contacts and including individual connector terminal means for external electrical connection thereto;

(b) a resilient current carrying member having a first portion secured to said housing means and a second portion extending distal said first portion and including a pair of moveable contacts mounted thereon intermediate said first and second portions with each disposed adjacent one of said pair of stationary contacts;

(c) spring means having an over-center movement and an actuator integrally formed therewith and operative for lost-motion movement and contact with said second portion of said current carrying member and upon a user effecting said over-center movement said current carrying member second portion effects rapid movement of said moveable contacts with respect to said stationary contacts.

* * * * *